US010584581B2

(12) United States Patent
Cao et al.

(10) Patent No.: US 10,584,581 B2
(45) Date of Patent: Mar. 10, 2020

(54) APPARATUSES AND METHOD FOR ATTACHING AN INSTRUMENTED CUTTING ELEMENT TO AN EARTH-BORING DRILLING TOOL

(71) Applicant: Baker Hughes, a GE company, LLC, Houston, TX (US)

(72) Inventors: Wanjun Cao, The Woodlands, TX (US); Steven W. Webb, The Woodlands, TX (US); Juan Miguel Bilen, The Woodlands, TX (US); Bo Yu, Spring, TX (US); Xu Huang, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 16/026,881

(22) Filed: Jul. 3, 2018

(65) Prior Publication Data

US 2020/0011170 A1 Jan. 9, 2020

(51) Int. Cl.

| | |
|---|---|
| ***E21B 10/42*** | (2006.01) |
| ***E21B 12/02*** | (2006.01) |
| ***E21B 49/00*** | (2006.01) |
| ***E21B 10/567*** | (2006.01) |
| *E21B 10/573* | (2006.01) |

(52) U.S. Cl.

CPC ..... *E21B 49/003* (2013.01); *E21B 10/42* (2013.01); *E21B 10/567* (2013.01); *E21B 12/02* (2013.01); *E21B 10/5735* (2013.01)

(58) Field of Classification Search

CPC ..... E21B 49/003; E21B 10/42; E21B 10/567; E21B 10/5735; E21B 12/02

See application file for complete search history.

(56) References Cited

U.S. PATENT DOCUMENTS

| | | | |
|---|---|---|---|
| 4,122,387 | A | 10/1978 | Ajam et al. |
| 4,268,276 | A | 5/1981 | Bovenkerk |

(Continued)

FOREIGN PATENT DOCUMENTS

| | | | |
|---|---|---|---|
| CA | 2848298 | A1 | 11/2011 |
| CN | 1603576 | A | 4/2005 |

(Continued)

OTHER PUBLICATIONS

Archie III: Electrical Conduction in Shaly Sands; Oct. 1989, Oilfield Review, vol. 1, Issue 3, pp. 43-53.

(Continued)

*Primary Examiner* — David J Bagnell
*Assistant Examiner* — Dany E Akakpo
(74) *Attorney, Agent, or Firm* — TraskBritt

(57) ABSTRACT

An instrumented cutting element, an earth-boring drilling tool, and related methods are disclosed. The instrumented cutting element may include a substrate base, a diamond table disposed on the substrate base, a sensor disposed within the diamond table, a lead wire coupled to the sensor and disposed within a side trench formed within the substrate base, and a filler material disposed within the side trench. The earth-boring drilling tool may include securing the instrumented cutting element to a blade of a bit body. A related method may include forming the instrumented cutting element and earth-boring drilling tool.

20 Claims, 14 Drawing Sheets

(56) References Cited

U.S. PATENT DOCUMENTS

| | | | | |
|---|---|---|---|---|
| 4,858,063 | A | 8/1989 | Laue et al. | |
| 6,206,108 | B1 | 3/2001 | MacDonald et al. | |
| 6,233,524 | B1 | 5/2001 | Harrell et al. | |
| 6,359,438 | B1 | 3/2002 | Bittar | |
| 6,404,003 | B1 | 6/2002 | McMillan et al. | |
| 6,850,068 | B2 | 2/2005 | Chemali et al. | |
| 7,052,215 | B2 | 5/2006 | Fukano | |
| 7,109,719 | B2 | 9/2006 | Fabris et al. | |
| 7,256,582 | B2 | 8/2007 | Gorek et al. | |
| 7,388,380 | B2 | 6/2008 | Chen et al. | |
| 7,407,566 | B2 | 8/2008 | Jiang et al. | |
| 7,697,375 | B2 | 4/2010 | Reiderman et al. | |
| 7,758,734 | B2 | 7/2010 | Jiang et al. | |
| 7,849,934 | B2 | 12/2010 | Pastusek et al. | |
| 7,946,357 | B2 | 5/2011 | Trinh et al. | |
| 8,006,781 | B2 | 8/2011 | Teodorescu et al. | |
| 8,203,134 | B2 | 6/2012 | Liu | |
| 8,203,344 | B2 | 6/2012 | Gold et al. | |
| 8,440,535 | B2 | 5/2013 | Dennison | |
| 8,937,292 | B2 | 1/2015 | Bateman | |
| 8,997,900 | B2 | 4/2015 | Sue et al. | |
| 9,133,668 | B2 | 9/2015 | Cardellini et al. | |
| 9,212,546 | B2 | 12/2015 | Scott et al. | |
| 9,406,877 | B2 | 8/2016 | Tada et al. | |
| 9,598,948 | B2 | 3/2017 | Scott et al. | |
| 2004/0069539 | A1* | 4/2004 | Sullivan | E21B 10/08 175/337 |
| 2005/0029095 | A1 | 2/2005 | Hall | |
| 2006/0243603 | A1 | 11/2006 | Jiang et al. | |
| 2007/0114061 | A1 | 5/2007 | Hall et al. | |
| 2008/0011521 | A1 | 1/2008 | Hall et al. | |
| 2008/0156534 | A1 | 7/2008 | Clark et al. | |
| 2008/0230280 | A1 | 9/2008 | Keshavan et al. | |
| 2008/0257730 | A1 | 10/2008 | Jiang et al. | |
| 2009/0205822 | A1 | 8/2009 | DiFoggio et al. | |
| 2009/0309600 | A1 | 12/2009 | Seydoux et al. | |
| 2010/0051292 | A1 | 3/2010 | Trinh et al. | |
| 2010/0139975 | A1 | 6/2010 | Teodorescu et al. | |
| 2010/0282510 | A1 | 11/2010 | Sullivan et al. | |
| 2010/0295548 | A1 | 11/2010 | Georgi et al. | |
| 2010/0314176 | A1* | 12/2010 | Zhang | E21B 10/573 175/383 |
| 2011/0036641 | A1 | 2/2011 | Lyons | |
| 2011/0057656 | A1 | 3/2011 | Tchakarov et al. | |
| 2011/0240372 | A1 | 10/2011 | Davis | |
| 2011/0259642 | A1 | 10/2011 | DiGiovanni et al. | |
| 2011/0266054 | A1 | 11/2011 | Kumar et al. | |
| 2011/0266055 | A1 | 11/2011 | DiGiovanni et al. | |
| 2011/0266058 | A1 | 11/2011 | Kumar et al. | |
| 2012/0132468 | A1 | 5/2012 | Scott et al. | |
| 2012/0152617 | A1 | 6/2012 | Hunt et al. | |
| 2012/0152622 | A1 | 6/2012 | Sue et al. | |
| 2012/0181900 | A1 | 7/2012 | Puccio et al. | |
| 2012/0303347 | A1 | 11/2012 | DiFoggio | |
| 2012/0312598 | A1 | 12/2012 | Cheng | |
| 2012/0325564 | A1 | 12/2012 | Vaughn et al. | |
| 2013/0088364 | A1 | 4/2013 | Bittar et al. | |
| 2013/0270007 | A1 | 10/2013 | Scott et al. | |
| 2013/0270008 | A1 | 10/2013 | DiGiovanni et al. | |
| 2014/0047776 | A1 | 2/2014 | Scott et al. | |
| 2016/0056208 | A1 | 2/2016 | Pellizzer et al. | |
| 2016/0133671 | A1 | 5/2016 | Fantini et al. | |
| 2016/0153244 | A1* | 6/2016 | Humphrey | E21B 12/02 175/39 |
| 2017/0175520 | A1 | 6/2017 | Scott et al. | |
| 2017/0284161 | A1* | 10/2017 | Zhang | E21B 10/5673 |
| 2018/0334858 | A1 | 11/2018 | Can | |

FOREIGN PATENT DOCUMENTS

| | | | |
|---|---|---|---|
| GB | 2483769 | A | 3/2012 |
| WO | 2011090481 | A1 | 7/2011 |
| WO | 2013191974 | A2 | 12/2013 |

OTHER PUBLICATIONS

Kong et al., A Theoretical Calculation of the Piezoresistivity and Magnetoresistivity in P-Type Semiconducting Diamond Films, Journal of Physics: Condensed Matter, vol. 14, pp. 1765-1774 (2002).

Digiovanni et al., U.S. Appl. No. 61/623,042, filed Apr. 11, 2012, and entitled "Apparatuses and Methods for At-Bit Resistivity Measurements for an Earth-Boring Drilling Tool".

* cited by examiner

APPARATUSES AND METHOD FOR ATTACHING AN INSTRUMENTED CUTTING ELEMENT TO AN EARTH-BORING DRILLING TOOL

CROSS-REFERENCE TO RELATED APPLICATIONS

The subject matter of this application is related to the subject matter of U.S. patent application Ser. No. 15/456,105, filed Mar. 10, 2017, pending, which is a continuation of U.S. patent application Ser. No. 13/586,650, filed Aug. 15, 2012, now U.S. Pat. No. 9,605,487, issued Mar. 28, 2017. The subject matter is also related to U.S. patent application Ser. No. 15/450,775, filed Mar. 6, 2017, pending, which is a continuation of U.S. patent application Ser. No. 14/950,581, filed Nov. 24, 2015, now U.S. Pat. No. 9,598,948, issued Mar. 21, 2017, which is a continuation of U.S. patent application Ser. No. 13/586,668, filed Aug. 15, 2012, now U.S. Pat. No. 9,212,546, issued Dec. 15, 2015. The disclosure of each of these applications and patents are incorporated herein by this reference in their entirety.

TECHNICAL FIELD

The present disclosure generally relates to earth-boring drill bits, cutting elements attached thereto, and other tools that may be used to drill subterranean formations. More particularly, embodiments of the present disclosure relate to instrumented cutting elements for obtaining at-bit measurements from an earth-boring drill bit during drilling.

BACKGROUND

The oil and gas industry expends sizable sums to design cutting tools, such as downhole drill bits including roller cone rock bits and fixed-cutter bits. Such drill bits may have relatively long service lives with relatively infrequent failure. In particular, considerable sums are expended to design and manufacture roller cone rock bits and fixed-cutter bits in a manner that minimizes the probability of catastrophic drill bit failure during drilling operations. The loss of a roller cone or a polycrystalline diamond compact from a bit during drilling operations can impede the drilling operations and, at worst, necessitate rather expensive fishing operations.

Diagnostic information related to a drill bit and certain components of the drill bit may be linked to the durability, performance, and the potential failure of the drill bit. In addition, characteristic information regarding the rock formation may be used to estimate performance and other features related to drilling operations. Logging while drilling (LWD), measuring while drilling (MWD), and front-end measurement device (FEMD) measurements are conventionally obtained from measurements behind the drill head, such as at several feet away from the cutting interface. As a result, errors and delay may be introduced into the data, which may result in missed pay-zones, delays in getting information, and drilling parameters that are not sufficiently optimized.

SUMMARY

Embodiments of the present disclosure include an earth-boring drilling tool. The earth-boring drilling tool comprises a body including at least one blade having an aperture extending therethrough, an instrumented cutting element secured to the at least one blade, and a conduit system. The instrumented cutting element comprises a substrate base, a diamond table disposed on the substrate base, a sensor disposed within the diamond table, and a lead wire coupled to the sensor. The sensor is configured to obtain data relating to at least one parameter related to at least one of a diagnostic condition of the cutting element, a drilling condition, a wellbore condition, a formation condition, or a condition of the earth-boring drilling tool. The conduit system is secured to the at least one blade such that the lead wire is received by the conduit system through the aperture of the at least one blade and extends back into an upper portion of the body to a data collection module.

Another embodiment includes an instrumented cutting element for an earth-boring drilling tool, comprising a substrate base, a diamond table disposed on the substrate base, a sensor disposed within the diamond table, a lead wire coupled to the sensor and disposed within a side trench formed within the substrate base, and a filler material disposed within the side trench. The sensor is configured to obtain data relating to at least one parameter related to at least one of a diagnostic condition of the cutting element, drilling condition, a wellbore condition, a formation condition, or a condition of the earth-boring drilling tool.

Another embodiment includes a method of forming an earth-boring drilling tool. The method comprises forming a substrate base and a diamond table with an embedded metal insert for an instrumented cutting element, forming a channel within the diamond table responsive to leaching at least a portion of the diamond table to remove the embedded metal insert, forming a side trench within at least a side portion of the substrate base to form contiguous open space with the channel, inserting a sensor within the channel and an associated a lead wire within the side trench, and disposing a filler material within the side trench. The sensor is configured to obtain data relating to at least one parameter related to at least one of a diagnostic condition of the cutting element, a drilling condition, a wellbore condition, a formation condition, or a condition of the earth-boring drilling tool.

DETAILED DESCRIPTION

Figure 1:
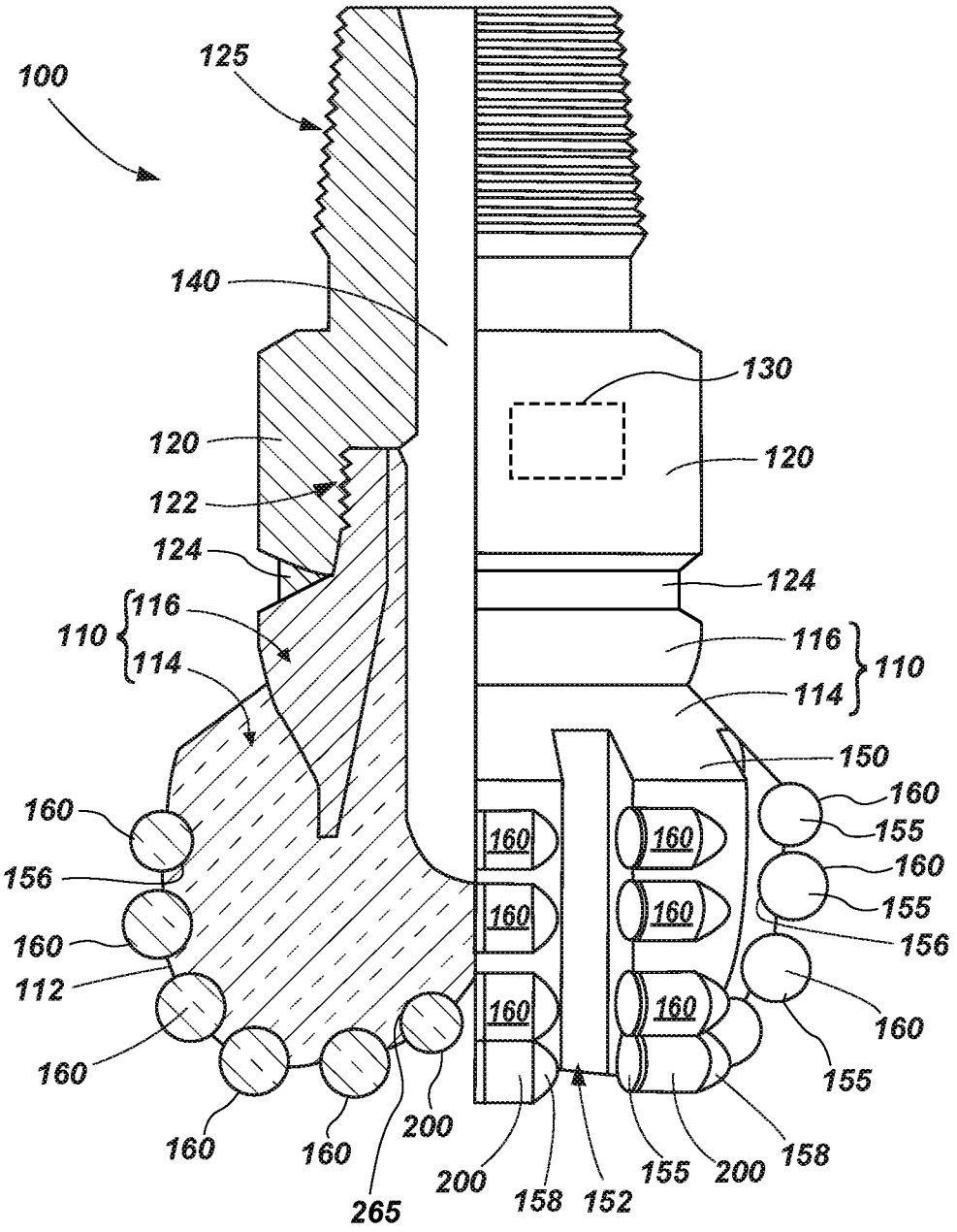
FIG. 1 illustrates a cross-sectional view of an exemplary earth-boring drill bit.

In the following detailed description, reference is made to the accompanying drawings that form a part hereof and, in which are shown by way of illustration, specific embodiments in which the disclosure may be practiced. These embodiments are described in sufficient detail to enable those of ordinary skill in the art to practice the disclosure, and it is to be understood that other embodiments may be utilized, and that structural, logical, and electrical changes may be made within the scope of the disclosure.

Referring in general to the following description and accompanying drawings, various embodiments of the present disclosure are illustrated to show its structure and method of operation. Common elements of the illustrated embodiments may be designated with the same or similar reference numerals. It should be understood that the figures presented are not meant to be illustrative of actual views of any particular portion of the actual structure or method, but are merely idealized representations employed to more clearly and fully depict the present disclosure defined by the claims below. The illustrated figures may not be drawn to scale.

As used herein, a "drill bit" means and includes any type of bit or tool used for drilling during the formation or enlargement of a well bore hole in subterranean formations and includes, for example, fixed cutter bits, rotary drill bits, percussion bits, core bits, eccentric bits, bi-center bits, reamers, mills, drag bits, roller cone bits, hybrid bits and other drilling bits and tools known in the art.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

As used herein, the term "hard material" means and includes any material having a Knoop hardness value of about 3,000 Kgf/mm$^2$ (29,420 MPa) or more. Hard materials include, for example, diamond and cubic boron nitride.

FIG. 1 is a cross-sectional view of an earth-boring drill bit 100, which may implement embodiments of the present disclosure. The earth-boring drill bit 100 includes a bit body 110. The bit body 110 of the earth-boring drill bit 100 may be formed from steel. In some embodiments, the bit body 110 may be formed from a particle-matrix composite material. For example, the bit body 110 may further include a crown 114 and a steel blank 116. The steel blank 116 is partially embedded in the crown 114. The crown 114 may include a particle-matrix composite material such as, for example, particles of tungsten carbide embedded in a copper alloy matrix material. The bit body 110 may be secured to the shank 120 by way of a threaded connection 122 and a weld 124 extending around the earth-boring drill bit 100 on an exterior surface thereof along an interface between the bit body 110 and the shank 120. Other methods are contemplated for securing the bit body 110 to the shank 120.

The earth-boring drill bit 100 may include a plurality of cutting elements 160, 200 attached to the face 112 of the bit body 110. The earth-boring drill bit 100 may include at least one instrumented cutting element 200 that is instrumented with a sensor configured to obtain real-time data related to the performance of the instrumented cutting element 200 and/or characteristics of the rock formation, such as resistivity measurements. In some embodiments the earth-boring drill bit 100 may also include non-instrumented cutting elements 160. The instrumented cutting elements 200 may be operably coupled with a data collection module 130 configured to receive and/or process the data signal from the sensor. The data collection module 130 may also include control circuitry that is configured to measure voltage and/or current signals from the sensors. The control circuitry may also include a power supply (e.g., voltage source or current source) that is used to energize the sensors for performing the measurements. The control circuitry may also include an oscillator to generate the current flowing through the subterranean formation at a desired frequency. In some embodiments, the data collection module 130 may be integrated within the earth-boring drill bit 100 itself or along another portion of the drill string. The data collection module 130 may also be coupled with a LWD system.

Generally, the cutting elements 160, 200 of a fixed-cutter type drill bit have either a disk shape or a substantially cylindrical shape. The cutting elements 160, 200 include a cutting surface 155 located on a substantially circular end surface of the cutting element 200. The cutting surface 155 may be formed by disposing a hard, super-abrasive material, such as mutually bound particles of polycrystalline diamond formed into a "diamond table" under high temperature, high pressure (HTHP) conditions, on a supporting substrate. The diamond table may be formed onto the substrate during the HTHP process, or may be bonded to the substrate thereafter. Such cutting elements 200 are often referred to as a polycrystalline compact or a polycrystalline diamond compact (PDC) cutting element 200.

The cutting elements 160, 200 may be provided along blades 150, and within pockets 156 formed in the face 112 of the bit body 110, and may be supported from behind by buttresses 158 that may be integrally formed with the crown 114 of the bit body 110. The cutting elements 200 may be fabricated separately from the bit body 110 and secured within the pockets 156 formed in the outer surface of the bit body 110. If the cutting elements 200 are formed separately from the bit body 110, a bonding material (e.g., adhesive, braze alloy, etc.) may be used to secure the cutting elements 160, 200 to the bit body 110. In some embodiments, it may not be desirable to secure the instrumented cutting elements 200 to the bit body 110 by brazing because the sensors 209 (FIG. 3) may not be able to withstand the thermal braze procedures. As a result, another bonding process may be performed (e.g., using adhesives). As shown in FIG. 1, the instrumented cutting elements 200 may be located near the bottom of the crown 114 of the bit body 110, whereas the non-instrumented cutting elements 160 are located on the sides of the crown 114. Of course, positioning the different types of cutting elements 160, 200 at different locations is also contemplated. Thus, it is contemplated that the earth-boring drill bit 100 may include any combination of instrumented cutting elements 200 and non-instrumented cutting elements 160 at a variety of different locations on the blades 150.

The bit body 110 may further include junk slots 152 that separate the blades 150. Internal fluid passageways (not shown) extend between the face 112 of the bit body 110 and a longitudinal bore 140, which extends through the shank 120 and partially through the bit body 110. Nozzle inserts (not shown) also may be provided at the face 112 of the bit body 110 within the internal fluid passageways.

The earth-boring drill bit 100 may be secured to the end of a drill string (not shown), which may include tubular pipe and equipment segments (e.g., drill collars, a motor, a steering tool, stabilizers, etc.) coupled end to end between the earth-boring drill bit 100 and other drilling equipment at the surface of the formation to be drilled. As one example, the earth-boring drill bit 100 may be secured to the drill string, with the bit body 110 being secured to the shank 120 having a threaded connection portion 125 and engaging with a threaded connection portion of the drill string. An example of such a threaded connection portion is an American Petroleum Institute (API) threaded connection portion.

During drilling operations, the earth-boring drill bit 100 is positioned at the bottom of a well bore hole such that the cutting elements 200 are adjacent the earth formation to be drilled. Equipment such as a rotary table or a top drive may be used for rotating the drill string and the drill bit 100 within the bore hole. Alternatively, the shank 120 of the earth-boring drill bit 100 may be coupled to the drive shaft of a down-hole motor, which may be used to rotate the earth-boring drill bit 100. As the earth-boring drill bit 100 is rotated, drilling fluid is pumped to the face 112 of the bit body 110 through the longitudinal bore 140 and the internal fluid passageways (not shown). Rotation of the earth-boring drill bit 100 causes the cutting elements 200 to scrape across and shear away the surface of the underlying formation. The formation cuttings mix with, and are suspended within, the drilling fluid and pass through the junk slots 152 and the annular space between the well bore hole and the drill string to the surface of the earth formation.

When the cutting elements 160, 200 scrape across and shear away the surface of the subterranean formation, a significant amount of heat and mechanical stress may be generated. Components of the earth-boring drill bit 100 (e.g., the instrumented cutting elements 200) may be configured for detection of operational data, performance data, formation data, environmental data during drilling operations, as will be discussed herein with respect to FIGS. 2 through 14. For example, sensors may be configured to determine diagnostic information related to the actual performance or degradation of the cutting elements or other components of earth-boring drill bit 100, characteristics (e.g., hardness, porosity, material composition, torque, vibration, etc.) of the subterranean formation, or other measurement data. In addition, measurements obtained by the instrumented cutting elements 200 during drilling may enable active bit control (e.g., geosteering), such as by correlating wear condition, active depth of cut control, understanding the extent of formation engagement while drilling, pad-type formation resistivity measurements, and/or identifying where in the earth-boring drill bit 100 instabilities may originate. As will be described below, at-bit measurements may be obtained from the one or more instrumented cutting elements 200, such as from a plurality of instrumented cutting elements 200 positioned at various locations on the earth-boring drill bit 100.

Embodiments of the disclosure include methods for making an instrumented cutting element and drill bit used for determining at-bit measurements during drilling operations. The electrical signal for the measurements may be generated within the embedded sensor disposed within the diamond table of the cutting element of the earth-boring drill bit. The data collection module 130 may store and process the information and adjust the aggressiveness of the self-adjusting and/or manual-adjusting bit to optimize the drilling performance. For example, if a measured temperature of the cutting element 200 exceeds a pre-set value, the data collection module 130 may send a signal to the self-adjusting module inside the bit to adjust cutter depth of cut or generate warnings transmitted to the rig floor (e.g., via a telemetry system) to allow the driller to change drilling parameters to mitigate the risk of overheating and damage cutters.

Figure 2:
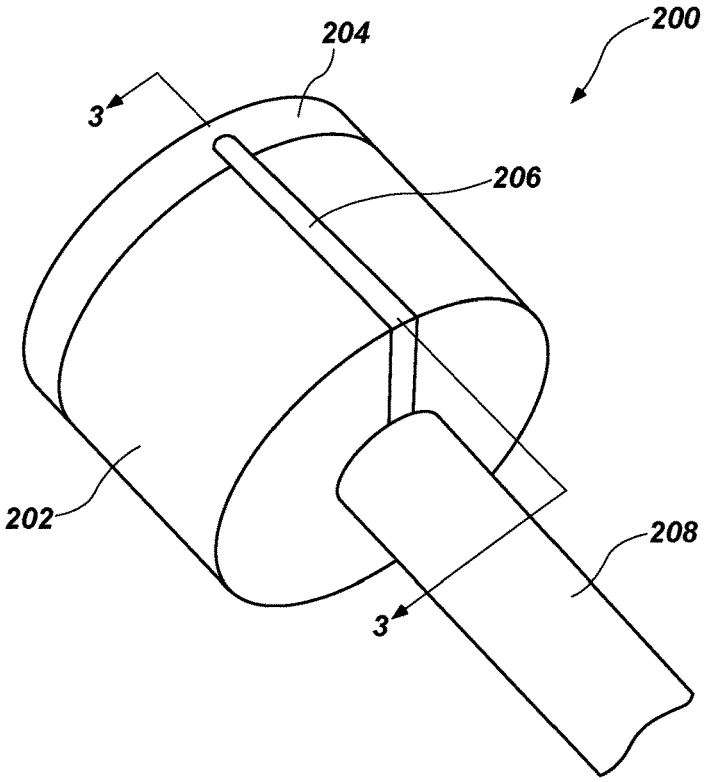
FIG. 2 is a perspective view of the instrumented cutting element of FIG. 1.
Figure 3:
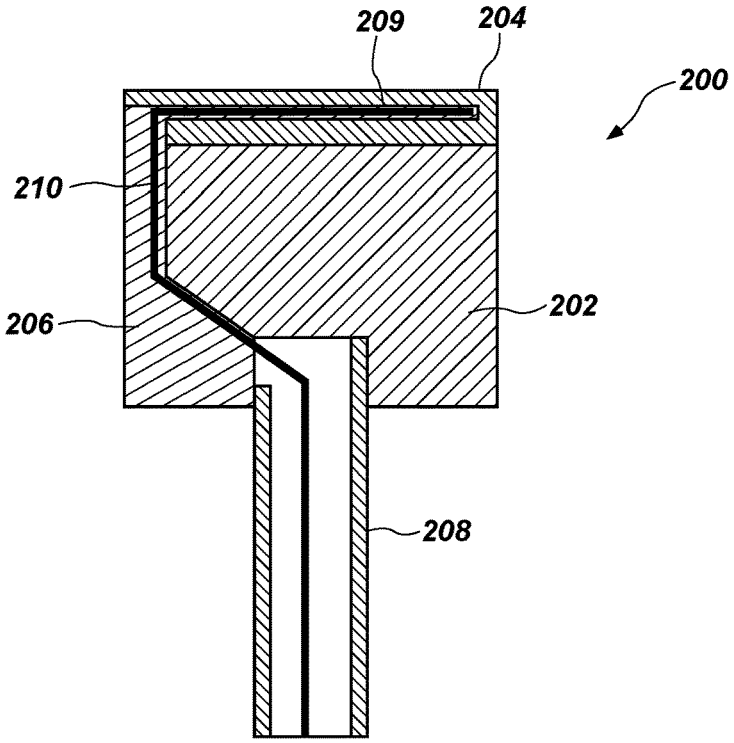
FIG. 3 is a cross-section of the instrumented cutting element of FIG. 2 taken along line 3-3.

FIG. 2 is a perspective view of the instrumented cutting element 200 of FIG. 1. FIG. 3 is a cross-section of the instrumented cutting element 200 of FIG. 2 taken along line 3-3 of FIG. 2.

The instrumented cutting element 200 may include a substrate 202 and a diamond table 204 formed thereon having a substantially cylindrical shape. In addition, the cutting element 200 may include a filler material 206 that may extend in a transverse direction of the cutting element 200 and extending into at least a portion of the substrate 202 and the diamond table 204 as formed within a trench as will be discussed further below. The width of the filler material 206 may be a relatively thin portion of the overall cutting element 200. Referring specifically to FIG. 3, the instrumented cutting element 200 may include a sensor 209 embedded within the diamond table 204. The sensor 209 may be coupled to a lead wire 210 that carries the signal from the sensor 209 to a data acquisition unit (not shown in FIG. 3). The sensor 209 may be configured to obtain data relating to at least one parameter related to at least one of a diagnostic condition of the cutting element (such as temperature, stress/strain state, magnetic field and electrical resistivity etc.), a drilling condition, a wellbore condition, a formation condition, or a condition of the earth-boring drilling tool. For example, the sensor 209 may include sensors such as thermocouples, thermistors, chemical sensors, acoustic transducers, gamma detectors, dielectric sensors, resistivity sensors, resistance temperature detectors (RTDs), piezoresistive sensors (e.g., doped diamond), and other similar sensors.

As discussed above, the diamond table 204 may be formed from a hard, super-abrasive material, such as mutually bound particles of polycrystalline diamond formed under HTHP conditions. The substrate 202 may be formed from a supporting material (e.g., tungsten carbide) for the diamond table 204. The filler material 206 may include metallic adhesives, ceramic-metallic adhesives/pastes, ceramic adhesive, silicate high-temperature glue, epoxies, and other like materials. In some embodiments, the side trench may be covered by a cap or cap material configured to close the opening of the side trench as a cover to the side trench without necessarily filling the entire side trench. In some embodiments, the cap material may extend at least partially into the side trench. Some embodiments may also include both the cap material and at least a portion of the side trench filled with filler material 206. The filler material 206 and/or cap material may be configured for retention of the sensor 209 and lead wire 210 as well as protection by being insulated from the environment during drilling operations.

A conduit 208 may also extend into at least a portion of the substrate 202 through a pocket formed through the bottom portion of the substrate 202 opposite the diamond table 204. The conduit 208 may extend approximately in the middle of the bottom portion of the substrate 202, and which may include an inner pathway used to route the lead wire 210 from the instrumented cutting element 200 to the data collection module 130. The diameter of the cavity that is formed within the substrate 202 to receive the conduit 208 may be larger than the width of the side trench that is formed to receive the lead wire 210.

Embodiments of the disclosure may utilize the diamond sintering process to directly embed a metal insert inside the diamond table 204 and create opening tunnels after removing the embedded metal inserts during the leaching process. Sensors can be inserted into the opening tunnels to ensure electrical insulation and protection. Thus, embodiments may be a cost-effective and a viable solution for the cutter sensing of temperature, wear scar progression, or crack propagation. The sensors 209 embedded within the diamond table 204 may take shape of metal inserts that may be embedded during the HTHP process. The shape of the sensors 209 may include a single sensor substantially linear in shape or a network/matrix having a shape designed by the metal inserts.

FIGS. 4A to 4F show a simplified and schematically illustrated cross-sections of an instrumented cutting element 200 of FIG. 1 at various stages of manufacturing illustrating a method of making the instrumented cutting element 200. The cross sections correspond to the portion of the cutting element 200 taken along line 3-3 of FIG. 2.

Figure 4A:
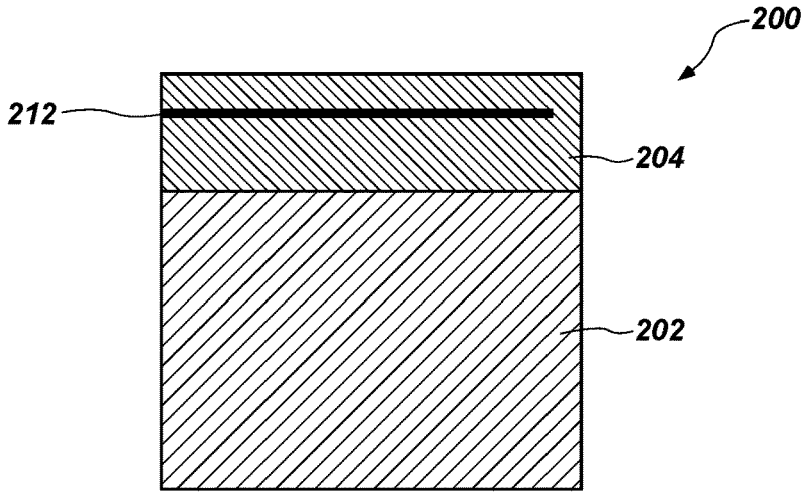
FIGS. 4A to 4F show simplified and schematically-illustrated cross-sections of an instrumented cutting element of FIG. 1 at various stages of manufacturing illustrating a method of making the instrumented cutting element.

In FIG. 4A, the cutting element 200 is formed with a substrate 202 and a diamond table 204 thereon. The diamond table 204 may also have a metal insert 212 embedded therein during formation thereof. The cutting element 200 may be formed by sintering a diamond powder with a tungsten carbide substrate in an HTHP process to form the diamond table 204 and the substrate 202. The metal insert 212 may be formed from a metal that may survive the HTHP process. As an example, the metal insert 212 may be a material exhibiting a melting temperature greater than 1600° C. As non-limiting examples, the metal insert 212 may be formed from materials including rhenium (Re), nickel (Ni), titanium (Ti) and their alloys. For example, the metal insert 212 may include an Re alloy wire (e.g., Re>5 wt %) embedded into the diamond table 204 during the sintering process forming the instrumented cutting element 200. Other examples of Re alloy include TaRe, WRe, OsRe, MoRe, IrRe, NbRe, RuRe, etc. Also, ternary or quaternary alloys are contemplated for the metal insert 212, such as TaWRe, MoWTaRe, etc.

In some embodiments, the metal insert 212 may include a wire (or wire network) that extends longitudinally across the diamond table 204. In other embodiments, the wire may be formed as different shapes (e.g., curved) when embedded into the diamond table 204. As the wire may be formed into various shapes, the material selected for the wire may exhibit a minimum hardness and strength for the desired shape to resist deformation and cracking. In some embodiments, the metal insert 212 may be substantially uniform, which provides a substantially uniform cavity (see FIG. 4C) for disposing the sensor (see FIG. 4E). It is also contemplated that the diameter of the metal insert 212 may not be uniform in some embodiments. For example, the tip of the metal insert 212 within the diamond table 204 may have a smaller diameter than the end of the metal insert 212 proximate the outer edge of the diamond table 204. A larger diameter proximate the outer edge may provide for a greater quantity of filler material (see FIG. 4F) to better retain the sensor.

Figure 4B:
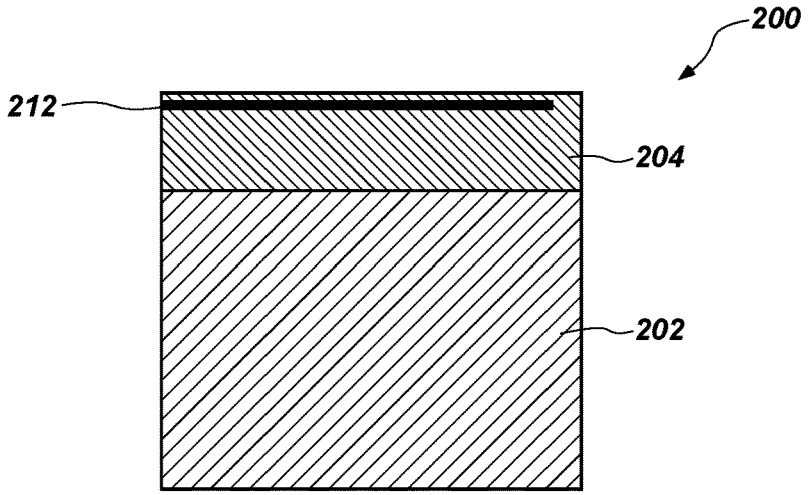

Referring to FIG. 4B, at least a portion of the diamond table 204 may be removed such that the metal insert 212 may be located closer to the surface of the diamond table 204. In some embodiments, the initial position of the metal insert 212 may be suitable such that removal of the portion of the diamond table 204 may not be necessary. Removing the diamond table 204 may be performed by a lapping process or other methods that would be apparent to those of ordinary skill in the art.

Figure 4C:
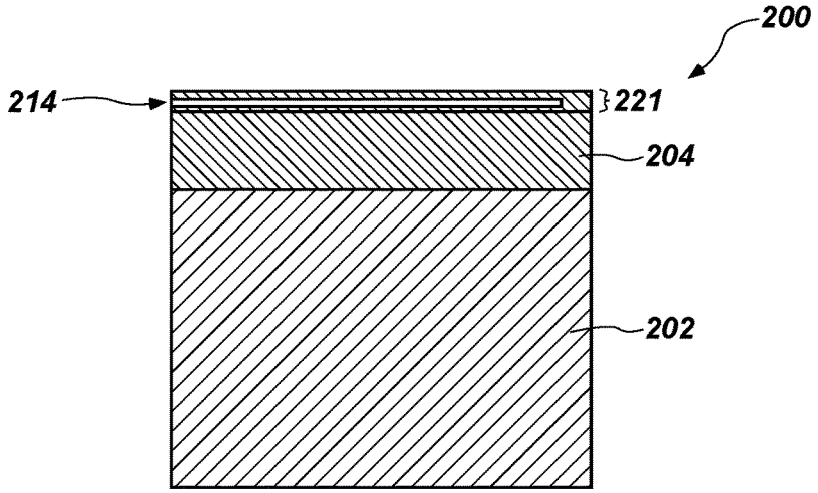

Referring to FIG. 4C, the metal insert 212 may be removed by removing the metal insert 212 embedded in the diamond table 204 to form an open channel 214. Removing the metal insert 212 may be performed by acid leaching all or a portion of the diamond table 204 or other methods that would be apparent to those of ordinary skill in the art. Assuming the entire metal insert 212 has been leached from the diamond table 204, the shape of the resulting open channel 214 may substantially be the shape of the metal insert 212. Because the leached portion 221 of the diamond table 204 is non-conductive, the electrical insulation for the sensor may be achieved. The resulting channel 214 may have an aspect ratio that is greater than what may otherwise be achievable using methods such as laser machining. Such other methods may also prove difficult in achieving a relatively uniform channel 214, and instead result in a more tapered channel 214. In some embodiments, the aspect ratio of the channel 214 may be greater than 20:1 (Length: Diameter). In some cases, the aspect ratio may be approximately 30:1 (e.g., 15 mm/0.5 mm).

Figure 4D:
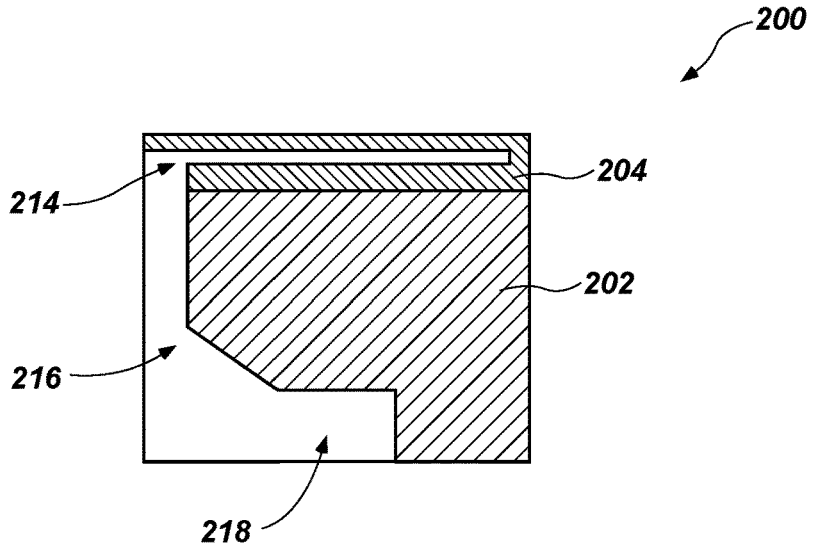

Referring to FIG. 4D, at least a portion of the substrate 202 may be removed to form a side trench 216 extending from the top of the substrate 202 to the bottom of the substrate 202. In addition, a cavity 218 may be formed at the bottom of the substrate 202, such as at a position that is near the center of the substrate 202. The side trench 216 and/or cavity 218 may be formed through a laser removal process, electrical discharge machining (EDM), or other similar processes. The cavity 218 may be formed to be a shape that is configured to receive the conduit (FIG. 2). The side trench 216 may connect to the cavity 218 to form a contiguous pathway from the channel 214 within the diamond table 204 to the cavity 218 at the bottom of substrate 202. To accomplish this contiguous pathway, at least a portion of the bottom area of the diamond table 204 may also need to be removed.

Figure 4E:
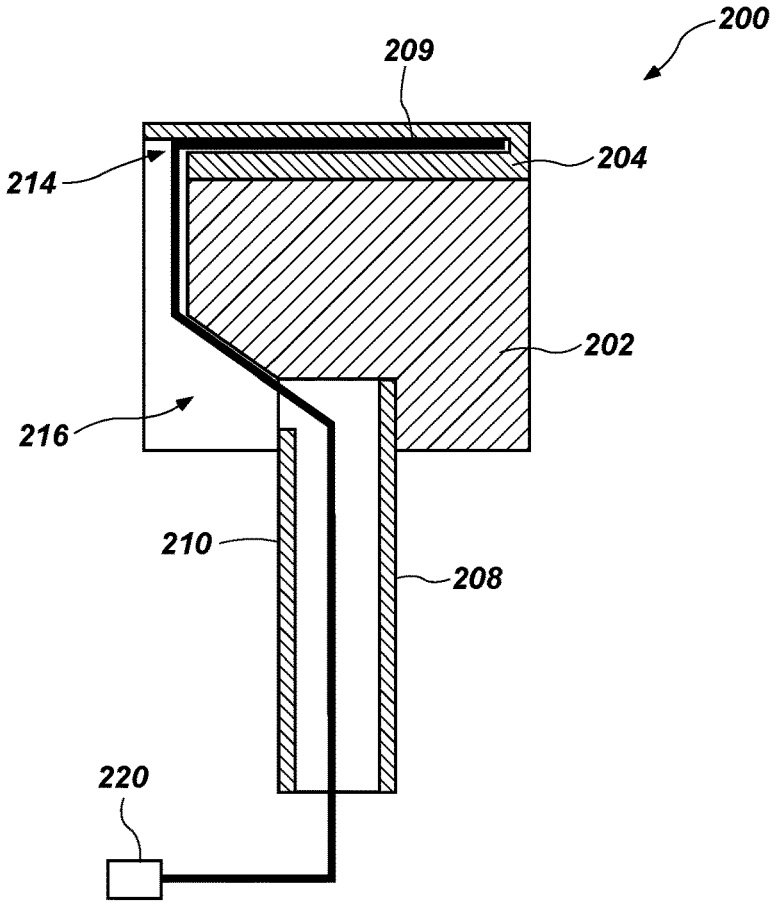

Referring to FIG. 4E, the sensor 209 may be inserted into the channel 214 of the diamond table 204, and the conduit 212 may be inserted into the cavity 218 of the substrate 202. The conduit 212 may be secured to the substrate 202 (e.g., via thread, braze, press fit, adhesive, etc.). In addition, the lead wire 210 coupled to the sensor 209 may be threaded through the side trench 216 and the conduit 212 and to a connector 220.

Figure 4F:
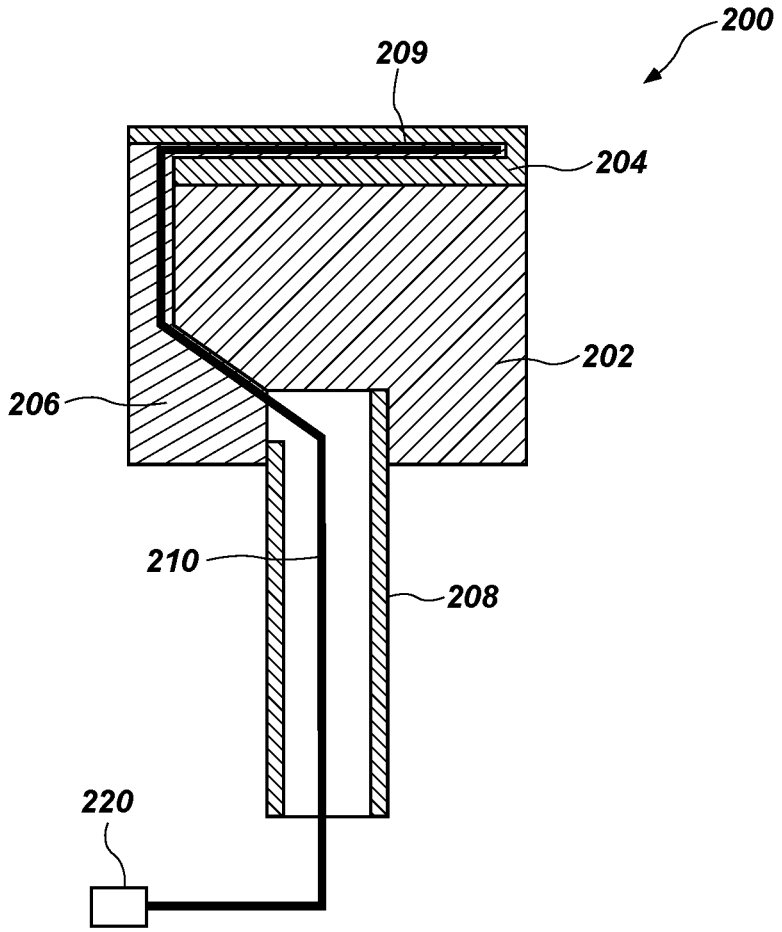

Referring to FIG. 4F, the filler material 206 may be disposed into the trench to secure and protect the sensor 209 and the lead wire 210.

Although FIGS. 4A to 4F show a single metal insert 212 used to form a single cavity 218, embodiments of the disclosure may include embedding multiple metal inserts to form multiple cavities. In such an embodiments, the metal inserts may have different characteristics, such as different shapes, different lengths, different diameters, etc. that may facilitate forming different types of sensors, or in some cases, disposing multiple sensors within a single cavity.

Figure 5:
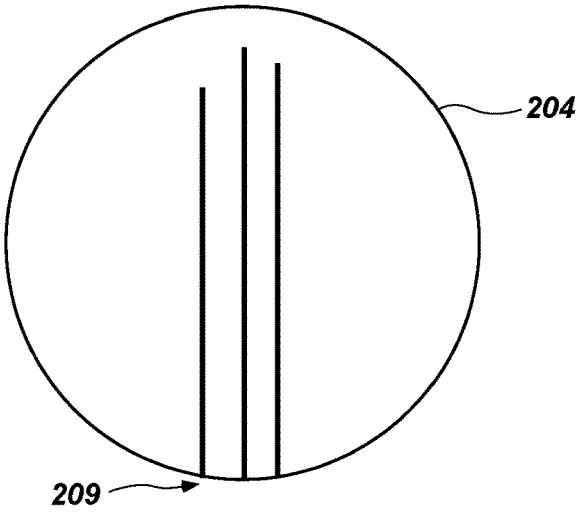
FIGS. 5 to 7 are top views of various configurations of the instrumented cutting elements according to embodiments of the disclosure.
Figure 6:
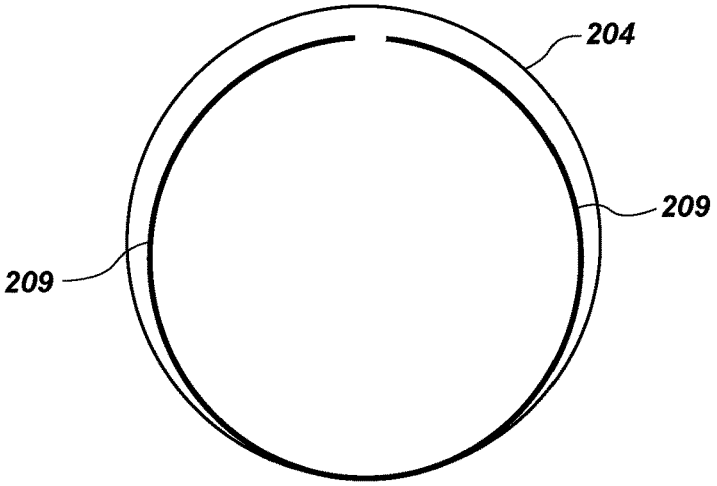
Figure 7:
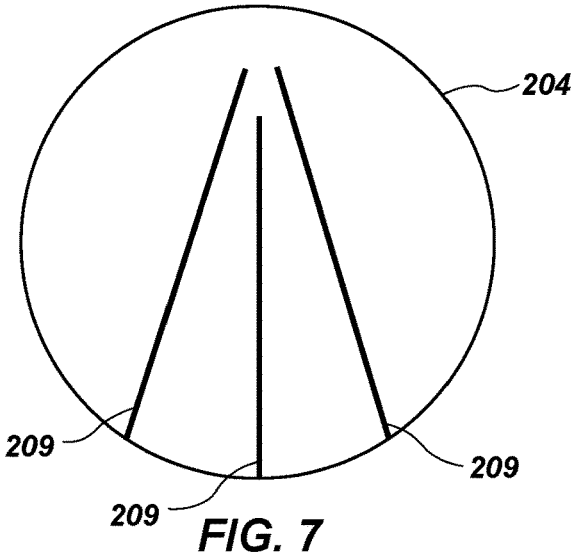

FIGS. 5 to 7 are top views of various configurations of the instrumented cutting elements according to embodiments of the disclosure. As shown herein, the sensors 209 may be embedded within the diamond tables 204 according to different shapes and numbers of sensors 209. As discussed above, the shapes of the sensors 209 may be based, in large part, on the shape of the metal insert used to form the cavity within the diamond table 204. For example, FIG. 5 shows sensors 209 positioned in a central portion of the diamond table 204, and which are also substantially parallel to each other. The sensors 209 of FIG. 5 may also have different lengths.

FIG. 6 shows multiple sensors 209 positioned in an outer portion of the diamond table 204, and which may be curved. The curved sensors 209 may be advantageous during the manufacturing process as the leaching process (see FIG. 4C) of the curved metal inserts proximate the outer perimeter may be improved compared with metal inserts in the inner area of the diamond table 204 because leaching depth on the outer perimeter may be deeper than the leaching depth on the top of the diamond table 204. In addition, having a curved channel on the outer perimeter (and corresponding sensor 209) may avoid weakening the center area of the diamond table.

FIG. 7 shows multiple sensors 209 positioned in a central portion of the diamond table 204, and which are also not parallel (i.e., angled) relative to each other. It is contemplated that the different sensors 209 embedded within a single diamond table 204 may also have other different characteristics (e.g., sensor type, material type, diameter size, etc.) relative to each other. In some embodiments, the different sensors 209 may be of the same sensor type such that each sensor 209 is a different channel coupled to the data collection module.

In some embodiments, the multiple sensors 209 may be disposed at different depths within the diamond table 204. Thus, a first sensor and the at least one additional sensor may be offset from each other in different planes relative to a cutting surface of the diamond table. Having multiple channels at different depths may provide information regarding the wear-scar depth for the instrumented cutting element as the sensors 209 proximate the cutting surface are destroyed. The lead wires to multiple sensors may be routed within different trenches formed (and then filled by filler material). In some embodiments, the same trench may be used. For example, a first lead wire may be inserted within the trench and a portion of filler material may be disposed within the trench to cover the first lead wire. A second lead wire may then be disposed within the trench and another portion of filler material may be disposed to cover the second lead wire. Different conduits or other forms of separation may also be used to separate the lead wires for data transmission to the data collection module.

Figure 8:
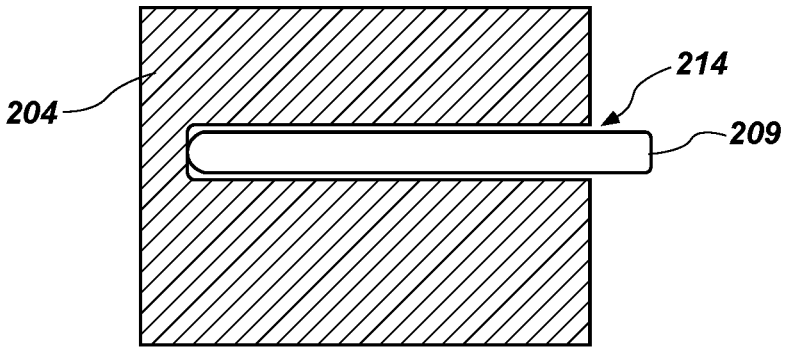
FIGS. 8 to 10 are side cross-sectional views of the diamond tables of various configurations of cutting elements according to additional embodiments of the disclosure.
Figure 9:
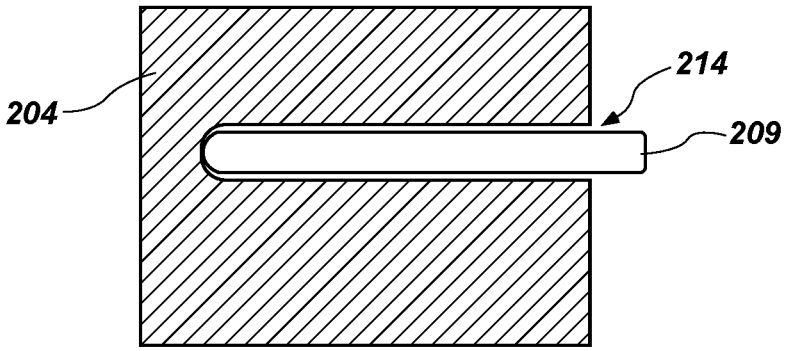
Figure 10:
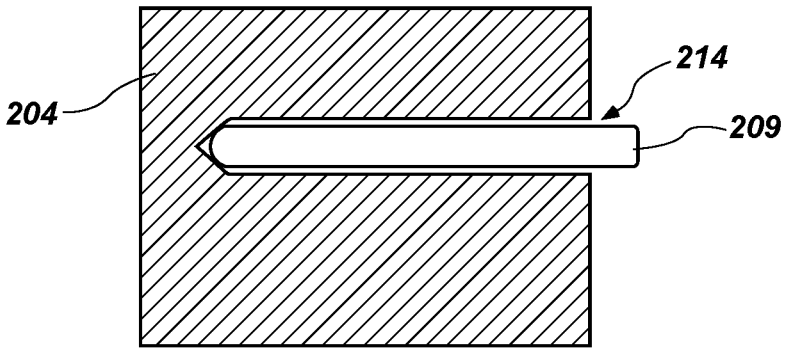

FIGS. 8 to 10 are side cross-sectional views of the diamond tables 204 of various configurations of cutting elements according to additional embodiments of the disclosure. As discussed, the shape of the channel 214 within the diamond table 204 may be substantially similar to the shape of the metal insert originally embedded during formation of the diamond table 204. The sensor 209 may also be substantially similar to the shape of the channel 214 by design of the metal insert. In some embodiments, however, the sensor 209 may not conform perfectly to the shape of the corresponding channel 214. For example, the tip of the channel 214 may be flat (FIG. 8), concave (FIG. 9), or pointed (FIG. 10), which may result in the sensor 209 with a curved tip having a different fit. A proper combination of sensor shape and channel shape may provide for better sensor sensitivity (e.g., thermal contact).

Figure 11:
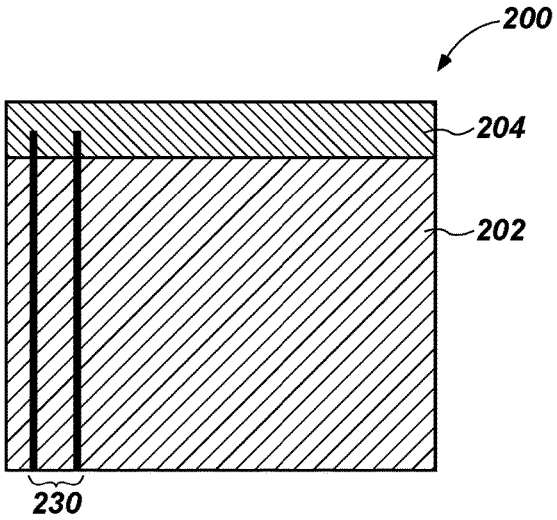
FIGS. 11 to 14 are side cross-sectional views of various configurations of cutting elements according to additional embodiments of the disclosure.
Figure 12:
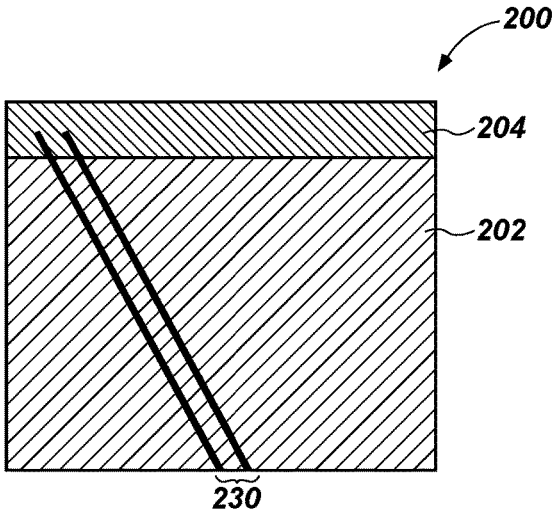
Figure 13:
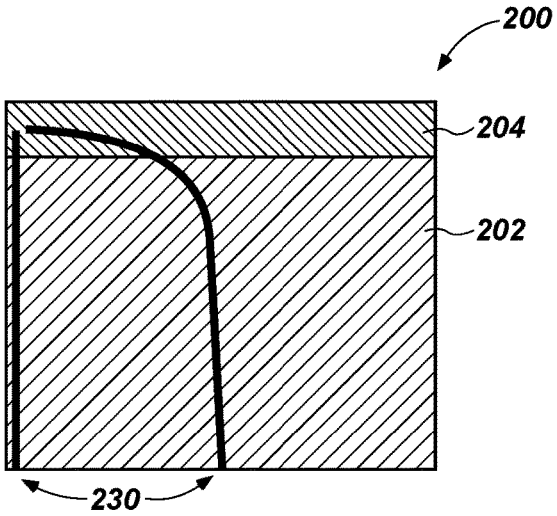
Figure 14:
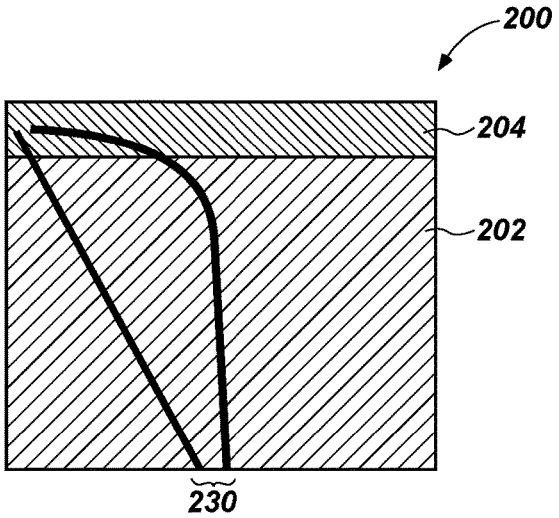

FIGS. 11 to 14 are side cross-sectional views of various configurations of cutting elements 200 according to additional embodiments of the disclosure. Rather than having the cavity and side trench, the substrate 202 may include one or more channels 230 formed (e.g., drilled) through the entirety of the substrate 202 to align and connect with the channel formed within the diamond table 204 so that the sensor and the conductive material have a path through the entirety of the substrate 202. In FIG. 11, the channels 230 may be linear and parallel with each other, and directionally oriented in the direction of the longitudinal axis of the instrumented cutting element 200. In FIG. 12, the channels 230 may be linear and parallel with each other, and directionally oriented in a direction that is angled to the longitudinal axis of the instrumented cutting element 200. In FIG. 13, the channels 230 may be a combination of linear and curved, with the linear channel 230 directionally oriented in the direction of the longitudinal axis of the instrumented cutting element 200. In FIG. 14, the channels 230 may be a combination of linear and curved, with the linear channel 230 directionally oriented in a direction that is angled to the longitudinal axis of the instrumented cutting element 200.

Figure 15A:
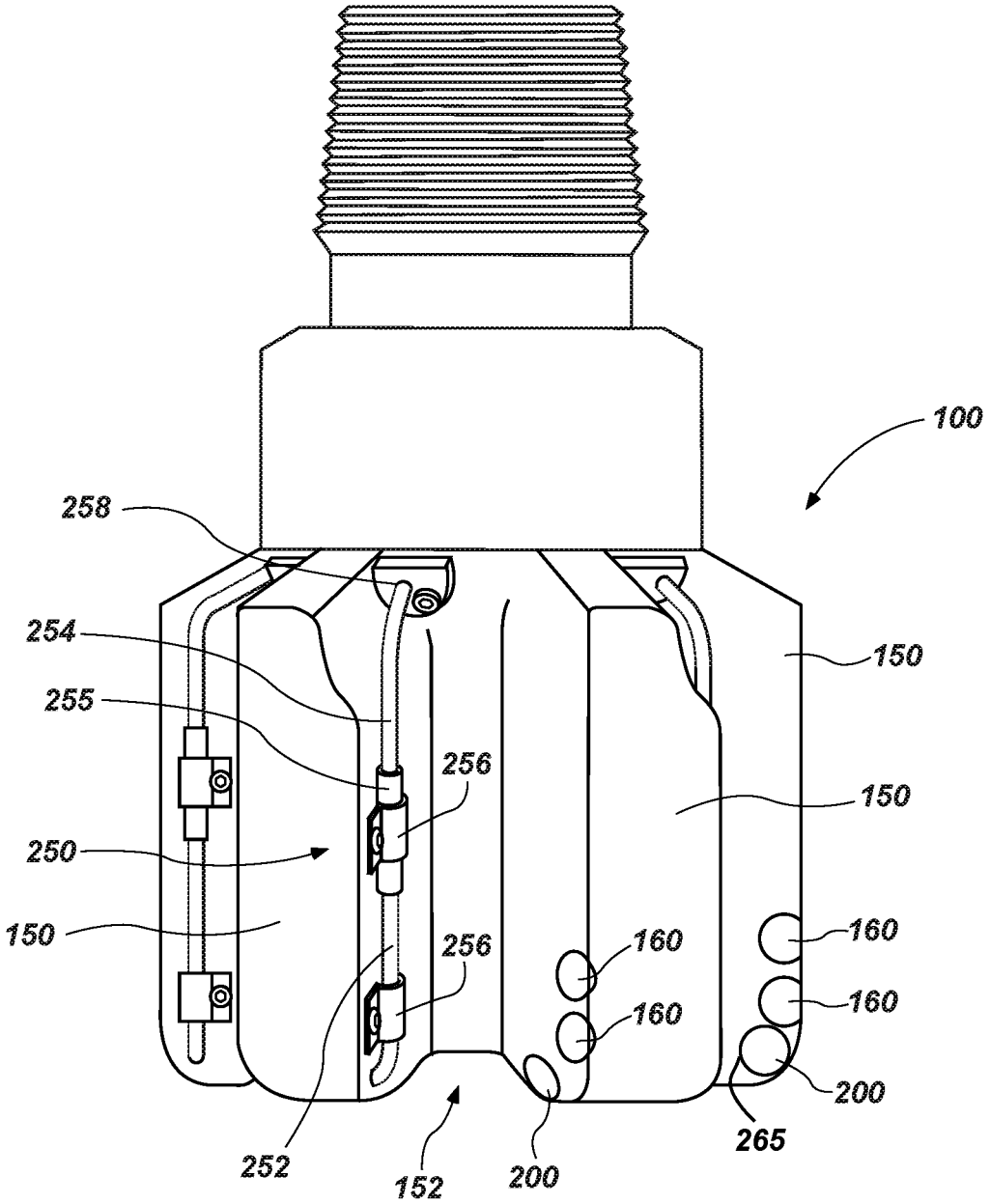
FIG. 15A is an outer-side view of the earth-boring drill bit rotated to show the junk slots that separate the blades.

FIG. 15A is an outer side view of an earth-boring drill bit 100 rotated to show the junk slots 152 that separate the blades 150 and with a conduit system 250 secured to the back surface of the blade 150. The conduit system 250 is configured to provide a protected passageway between the instrumented cutting element 200 to internal portions of the drill bit 100 where the data collection module may reside. In particular, the lead wire coupled to the sensor of the instrumented cutting element 200 be routed through aperture of the blade 150 as discussed more fully below, and further throughout the conduit system 250 to enter the bit body and couple with the data collection module.

The conduit system 250 may extend along the external portion of the blade 150 through the junk slot 152 and couple to the drill bit 100 at a connection point with seal 258. The extended conductive wiring may be further routed within the drill bit to reach the data collection module. The conduit system 250 may include multiple sections that may be coupled together at different joints. For example, a first section 252 may extend into the aperture formed within the blade 150 and bend along the outer surface of the back side of the blade 150. The first section 252 may connect to a second section of 254 at joint 255 and continue to extend up the surface of the bit body until a connection point for further entry into the bit body. Brackets 256 may be placed over the conduit system 250 to secure the conduit system to the blade 150. In some embodiments, the conduit system 250 may include a single section extending from the bottom of the blade 150 to the top region where the connection point to the drill bit body is located. Having multiple sections may have the benefit of more easily replacing the wiring and/or the instrumented cutting element by removing a second to access and disconnect the wiring.

Figure 15B:
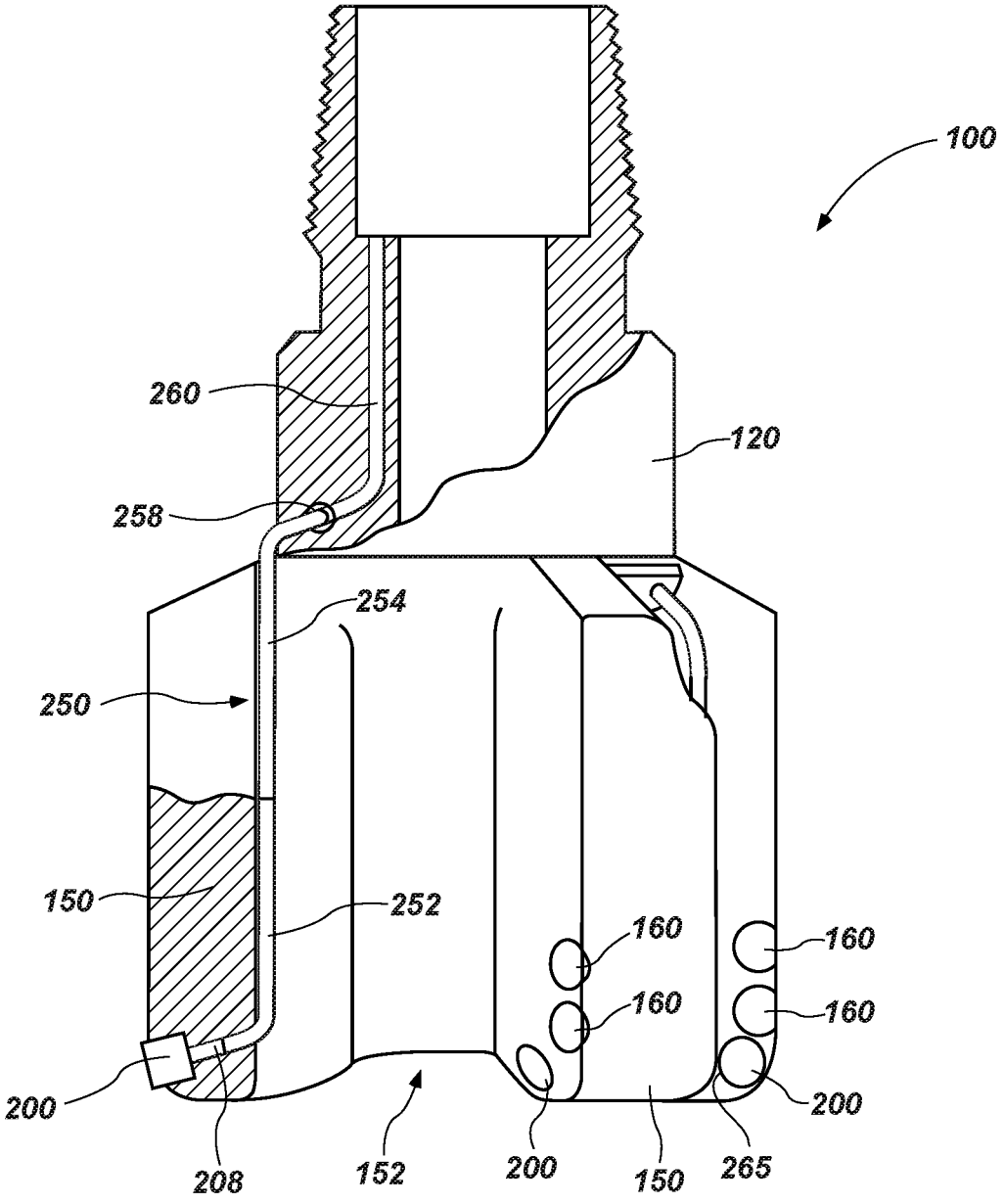
FIG. 15B is a simplified, partial cross-sectional view of FIG. 15A.

FIG. 15B is a simplified partial cross-sectional view of FIG. 15A. Many details of the earth-boring drill bit 100 are omitted for more clearly showing the conduit 208 of the instrumented cutting element 200 extending at least partially through the blade 150 to align with the portion of the first section 252 of the conduit system 250 that extends at least partially into the backside of the blade 150 to receive the conductive wiring. As the second section 254 of the conduit system 250 aligns with the internal passageways at the upper portion of the drill bit 100, a seal 258 may be placed at that connection point. A third section 260 of the conduit system 250 may be located within the shank 120 and align with the upper portion of the second section 254 at or near the seal 258 to further guide the wiring to the data collection module.

Figure 16A:
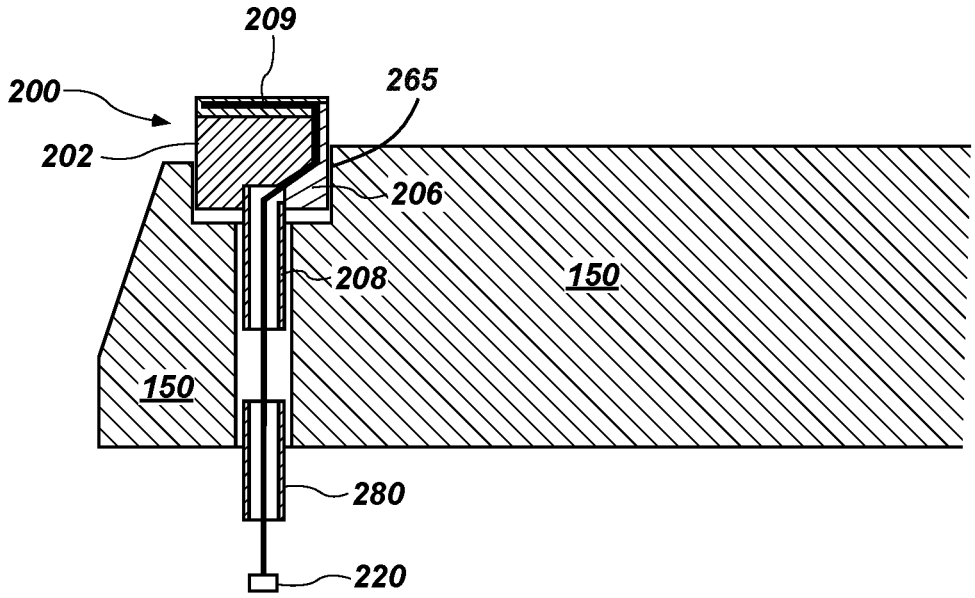
FIGS. 16A and 16B are side cross-sectional views of a portion of an earth-boring drill bit at various stages of manufacturing illustrating a method of connecting the instrumented cutting element to the data collection module.
Figure 16B:
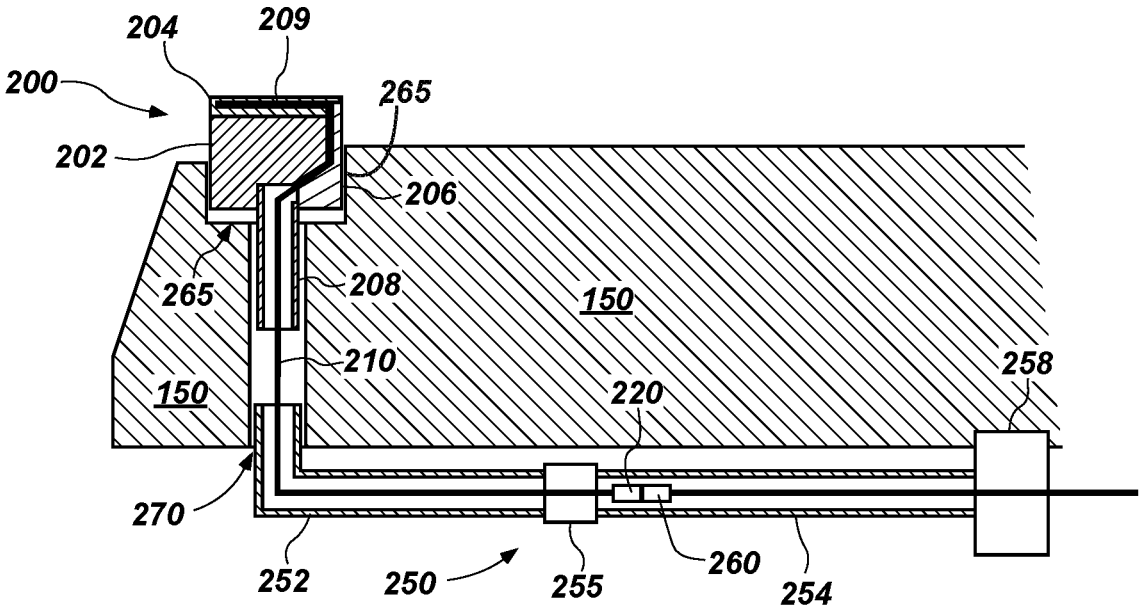

FIGS. 16A and 16B are side cross-sectional views of a portion of an earth-boring drill bit at various stages of manufacturing illustrating a method of connecting the instrumented cutting element 200 to the data collection module. Referring first to FIG. 16A, the instrumented cutting element 200 may be inserted into a pocket 265 of the blade 150. The back of the pocket 265 may also include an aperture 270 that extends through the blade 150. Thus, prior to inserting the instrumented cutting element 200, the blade 150 may have an open pocket 265 having a sufficient size and shape to receive the instrumented cutting element 200 and an aperture 270 extending from the back of the pocket 265 through the entirety of the blade 150 that has a sufficient size and shape to receive the conduit 208 of the instrumented cutting element 200.

The conduit 208 attached to the instrumented cutting element 200 and the corresponding lead wire 210 may be inserted into the aperture 270 of the blade 150. A temporary guide tube 280 may also be inserted through the back side of the aperture 270 to facilitate the threading of the lead wire 210 and connector 220 to pass completely through the blade 150. The conduit 208 and guide tube 280 may also serve to protect the lead wire 210 from the flame during brazing process. The instrumented cutting element 200 may then be affixed to the blade, such as through a brazing process. The location of the conduit 208 at the center of the axis of the instrumented cutting element 200 and the aperture 270 being located in the center of the pocket 265 may allow the instrumented cutting element 200 to be rotated during the brazing process.

Referring to FIG. 16B, the temporary guide tube 280 (FIG. 16A) may be removed, and then replaced by the conduit system 250 that may be inserted into the aperture 270 of the blade to align with the conduit 208 of the instrumented cutting element 200. The conduit system 250 receives the lead wire 210 and the corresponding connector 220. Although FIG. 16B shows a substantial gap within the aperture 270 of the blade 150 and the conduit 208 of the instrumented cutting element 200, it is contemplated that the gap between the portion of the conduit system 250 within the aperture 270 and the conduit 208 of the instrumented cutting element 200 to be minimal. In some embodiments, the portion of the conduit system 250 extending within the aperture 270 and the conduit 208 of the instrumented cutting element 200

The connector 220 may couple with another connector 260 and corresponding conductive wiring to further extend the path for the signals to be transmitted through the conduit system 250 into the drill bit 100 and further to the data acquisition unit. The conduit system 250 may extend along the external portion of the blade 150 through the junk slot 152 and couple to the drill bit at a connection point with seal 252. The extended conductive material may be further routed within the drill bit to reach the data collection module.

As discussed above, the conduit system 250 may include multiple sections 252, 254 that may be coupled together at different joints. For example, the first section 252 may extend into the aperture 270 formed within the blade 150 and bend along the outer surface of the back side of the blade 150. The first section 252 may connect to the second section of 254 at joint 255 and continue to extend up the surface of the bit body until a connection point for further entry into the bit body. If it becomes desirable to remove (or replace) the instrumented cutting element 200, one or more sections of the conduit system may be removed (e.g., disconnected at one of the joints) and the connectors 220, 260 may be disconnected from each other. The instrumented cutting element 200 may be removed from the pocket 265 of the blade 150 via a de-brazing process, after which the instrumented cutting element 200 along with its conduit 208 and lead wire 210 may be removed and replaced with a similarly configured instrumented cutting element. The new connector from the new instrumented cutting element may then be coupled to connector 260 and the first section 252 of the conduit system may be reattached to the second section 254 and secured to the blade 150.

In some embodiments, the conduit 208 of the instrumented cutting element may have a length that extends completely through the aperture of the blade 150 such that the first section 252 of the conduit system 250 may not need to extend into the aperture 270. As a result, a corner joint may be coupled at or near the aperture 270 to couple the conduit 208 of the instrumented cutting element 200 and the first section 252 of the conduit system 250.

Figure 17:
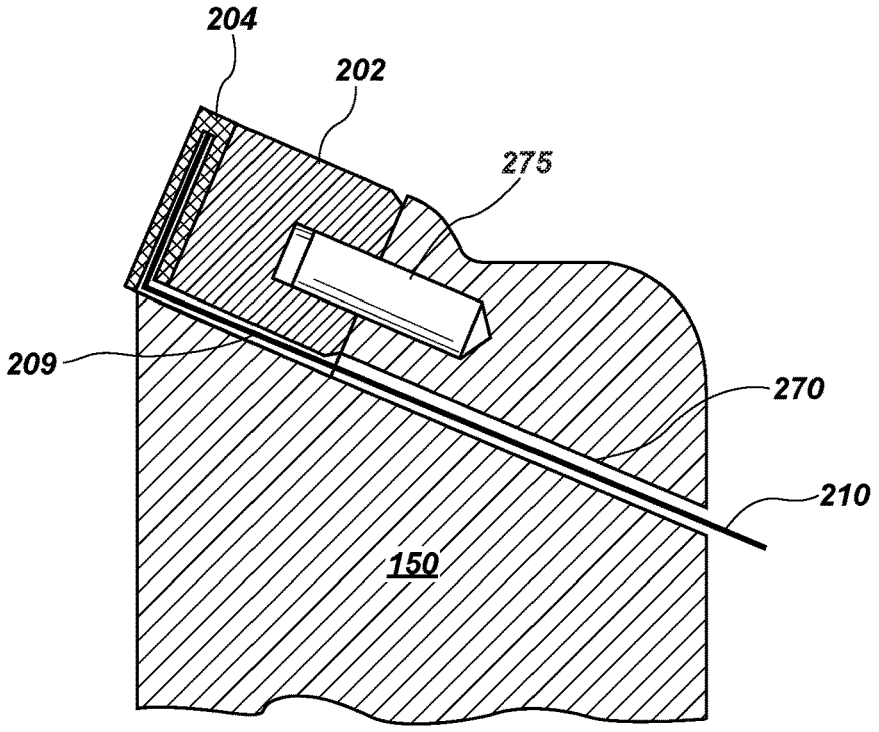
FIG. 17 is a side cross-sectional view of a portion of an earth boring drill bit showing another method of securing the instrumented cutting element according to another embodiment of the disclosure.

FIG. 17 is a side cross-sectional view of a portion of an earth boring drill bit showing another method of securing the instrumented cutting element 200 according to another embodiment of the disclosure. In this example, a retention pin 275 may be a shape memory alloy implanted within the substrate 202 and also into the blade 150. Thus, brazing the cutting element 200 to the blade 150 may not be required. The retention pin 275 may be attached to the substrate 202, and the lead wire 210 may be routed around the retention pin 275. As a result, the lead wire 210 may not be routed through the center of the substrate 202. Instead, the lead wire 210 may be routed through a trench along the outer perimeter of the substrate 202 to align with a corresponding aperture 270 in the blade 150. In some embodiments, the retention pin 275 may have a channel formed therein such that the lead wire 210 may be threaded through the retention pin 275.

Figure 18:
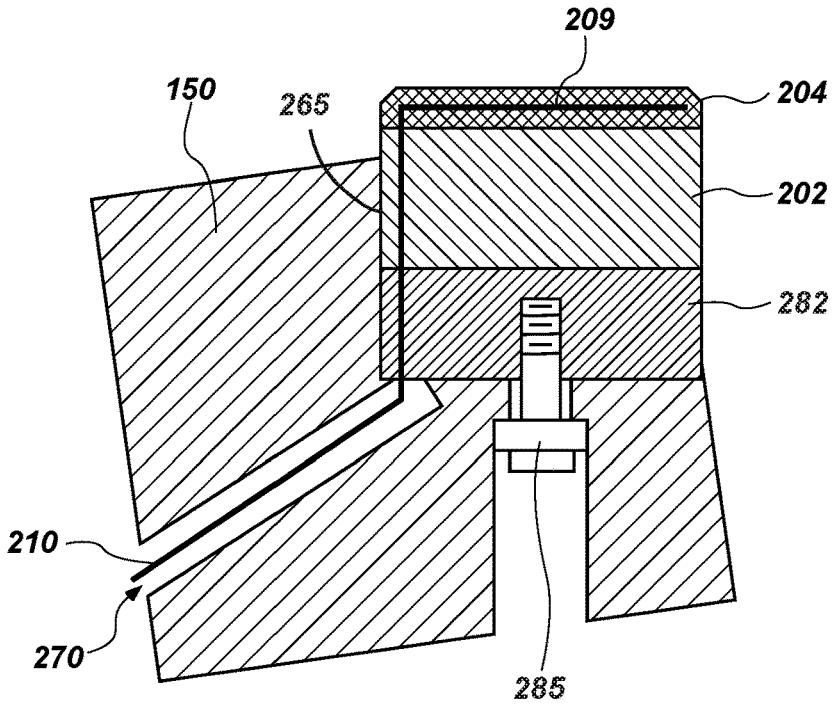
FIG. 18 is a side cross-sectional view of a portion of an earth boring drill bit showing another method of securing the instrumented cutting element according to another embodiment of the disclosure.

FIG. 18 is a side cross-sectional view of a portion of an earth boring drill bit showing another method of securing the instrumented cutting element 200 according to another embodiment of the disclosure. In this example, a secondary steel backing 282 may be formed on the bottom of the substrate 202. The steel backing 282 may facilitate securing the instrumented cutting element 200 to the blade 150 via a steel bolt 285 or other attachment mechanism.

Figure 19:
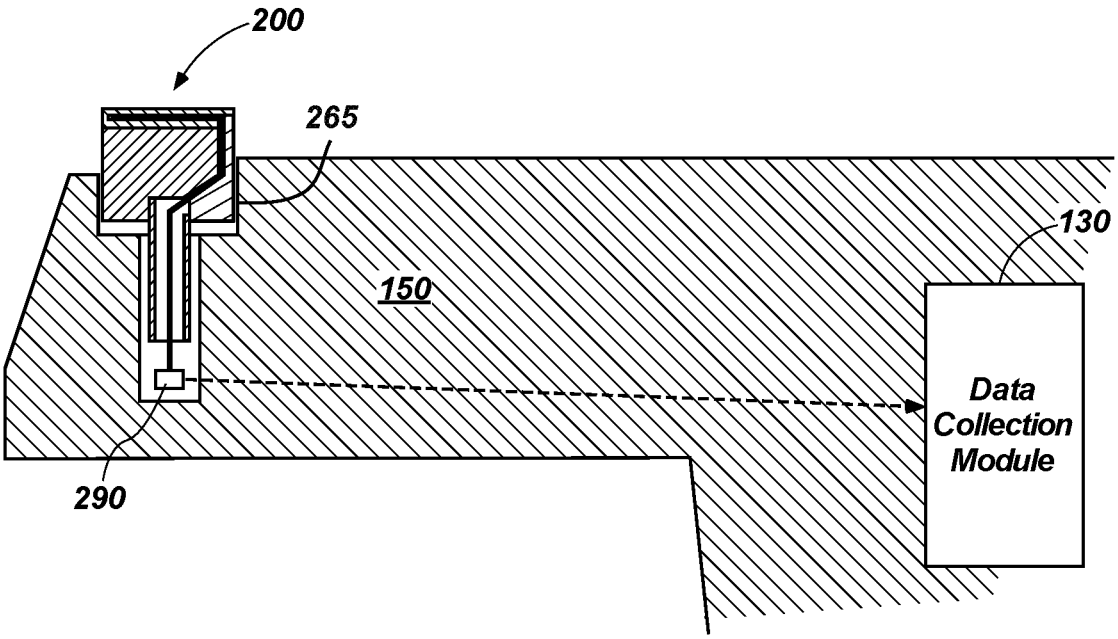
FIG. 19 is a simplified schematic diagram of a portion of the earth-boring drill bit according to another embodiment of the disclosure.

FIG. 19 is a simplified schematic diagram of a portion of the earth-boring drill bit according to another embodiment of the disclosure. In particular, the conduit of the instrumented cutting element 200 does not extend completely through the blade 150 as in prior examples. Rather, the blade includes a cavity in which a wireless transmitter 290 coupled to the instrumented cutting element 200 is housed. The wireless transmitter 290 is configured to wirelessly transmit the measurement data to the data collection module 130 during drilling operations, such as via radio frequency (RF), Wi-Fi, BLUETOOTH®, near-field communication (NFC), and other wireless communication standards and protocols.

Figure 20:
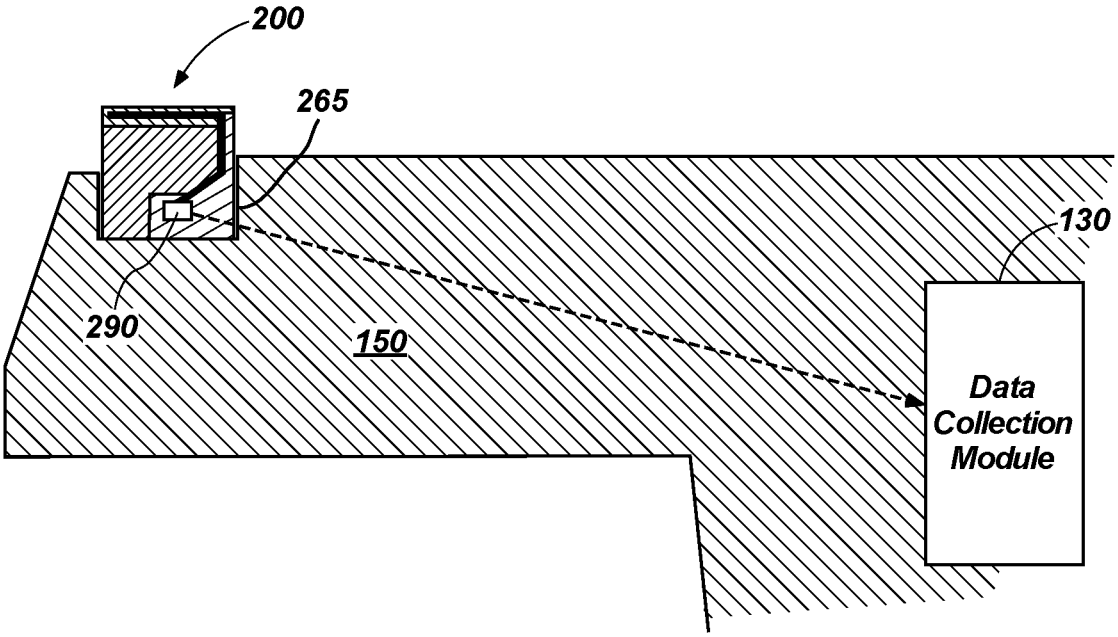
FIG. 20 is a simplified schematic diagram of a portion of the earth-boring drill bit according to another embodiment of the disclosure.

FIG. 20 is a simplified schematic diagram of a portion of the earth-boring drill bit according to another embodiment of the disclosure. In particular, the wireless transmitter 290 is embedded within the instrumented cutting element 200. For example, the wireless transmitter 290 may be embedded within the filler material and inserted into the side trench and/or cavity during manufacturing when inserting the sensor and other wiring. As with FIG. 19, the wireless transmitter 290 is configured to wirelessly transmit the measurement data to the data collection module 130 during drilling operations.

Figure 21:
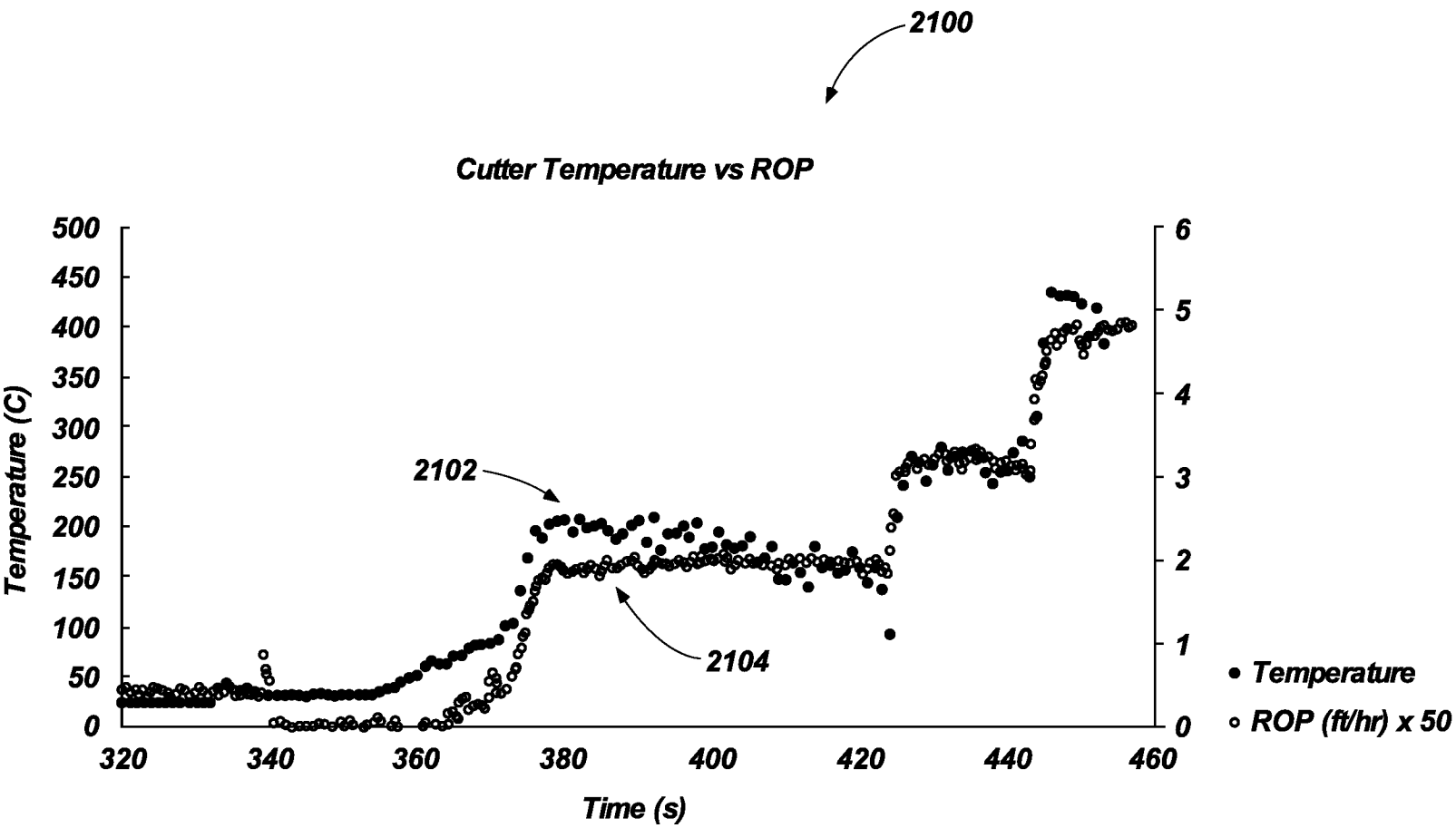
FIG. 21 is a plot showing measurement data indicative of the relationship between the measured cutter temperature and the rate of penetration of the drilling tool during a drilling operation.

FIG. 21 is a plot 2100 showing measurement data indicative of the relationship between the measured cutter temperature 2102 and the rate of penetration (ROP) 2104 of the drilling tool during a drilling operation. As apparent by FIG. 21, the measured cutter temperature 2102 and the ROP 2104 are correlated in the test data such that during operation, measuring the cutter temperature 2102 through the instrumented cutting element may be transmitted through the lead wire and ultimately to the data collection module for further processing and analysis. In this example, the cutter temperature 2102 may be converted (e.g., by a look up table, conversion formula, etc.) to a ROP 2104 that may be displayed to an operator. Additional data may also be derived from the temperature data or other sensor data depending on the sensor type, including for example, wear scar progression, crack propagation, characteristics (e.g., hardness, porosity, material composition, torque, vibration, etc.) of the subterranean formation, or other measurement data.

Although the foregoing description contains many specifics, these are not to be construed as limiting the scope of the present disclosure, but merely as providing certain exemplary embodiments. Similarly, other embodiments of the disclosure may be devised which do not depart from the scope of the present disclosure. For example, features described herein with reference to one embodiment also may be provided in others of the embodiments described herein. The scope of the disclosure is, therefore, indicated and limited only by the appended claims and their legal equivalents, rather than by the foregoing description.

What is claimed is:

1. An earth-boring drilling tool, comprising:
- a body including at least one blade having an aperture extending therethrough;
- an instrumented cutting element secured to the at least one blade, the instrumented cutting element comprising:
  - a substrate base;
  - a diamond table disposed on the substrate base;
  - a sensor disposed within the diamond table, wherein the sensor is configured to obtain data relating to at least one parameter related to at least one of a diagnostic condition of the cutting element, a drilling condition, a wellbore condition, a formation condition, or a condition of the earth-boring drilling tool; and
  - a lead wire coupled to the sensor; and
- a conduit system secured to the at least one blade such that the lead wire is received by the conduit system through the aperture of the at least one blade and extends back into an upper portion of the body to a data collection module;
  - wherein the conduit system includes multiple sections detachably coupled together outside of the at least one blade, and the lead wire includes multiple sections detachably coupled together by connectors.

2. The earth-boring drilling tool of claim 1, wherein the instrumented cutting element further comprises a conduit extending into a cavity formed in the substrate that guides the lead wire from the sensor to the aperture of the at least one blade.

3. The earth-boring drilling tool of claim 2, wherein the conduit extends outwardly from the substrate and into the aperture of the at least one blade.

4. The earth-boring drilling tool of claim 3, wherein the conduit is positioned at a center axis of the substrate base.

5. The earth-boring drilling tool of claim 1, wherein the instrumented cutting element is secured to the at least one blade by a braze alloy.

6. The earth-boring drilling tool of claim 1, wherein the instrumented cutting element is secured to the at least one blade by a retention pin.

7. The earth-boring drilling tool of claim 1, wherein the instrumented cutting element is secured to the at least one blade by a steel bolt.

8. The earth-boring drilling tool of claim 1, the instrumented cutting element further comprising:
- a wireless transmitter coupled to the lead wire; and
- the data collection module disposed within the earth-boring drilling tool configured to wirelessly communicate and receive sensor data from the wireless transmitter of the instrumented cutting element.

9. The earth-boring drilling tool of claim 8, wherein the wireless transmitter is disposed within the substrate base.

10. The earth-boring drilling tool of claim 8, wherein the instrumented cutting element further includes a conduit secured to the substrate base to receive the lead wire and extending into a cavity of the at least one blade, and wherein the wireless transmitter is disposed within the cavity of the at least one blade.

11. The earth-boring drilling tool of claim 1, wherein the a portion of an outer perimeter of the substrate base defines a side trench extending longitudinally from a top of the substrate base to a bottom of the substrate base.

12. The earth-boring drilling tool of claim 11, wherein the lead wire may be routed through the side trench of the substrate base to align with a aperture in the at least one blade.

13. The earth-boring drilling tool of claim 11, wherein a wireless transmitter is disposed within a filler material and inserted into the side trench of the substrate base.

14. An earth-boring drilling tool, comprising:
- a body including at least one blade having an aperture extending therethrough;
- an instrumented cutting element secured to the at least one blade, the instrumented cutting element comprising:
  - a substrate base;
  - a diamond table disposed on the substrate base;
  - a sensor disposed within the diamond table, wherein the sensor is configured to obtain data relating to at least one parameter related to at least one of a diagnostic condition of the cutting element, a drilling condition, a wellbore condition, a formation condition, or a condition of the earth-boring drilling tool; and
  - a lead wire coupled to the sensor; and
- a conduit system wherein the conduit system:
  - is secured to the at least one blade such that the lead wire is received by the conduit system through the aperture of the at least one blade;
  - extends back into an upper portion of the body to a data collection module;

extends into a cavity formed in the substrate that guides the lead wire from the sensor to the aperture of the at least one blade;

extends outwardly from the substrate and into the aperture of the at least one blade;

is positioned at a center axis of the substrate base; and includes a first section that extends into the aperture of the at least one blade and bends out of the aperture to extend along a back side of the at least one blade.

15. The earth-boring drilling tool of claim 14, wherein the conduit system further includes a second section detachably coupled to the first section, and extending to a connection point proximate a shank of the earth-boring drilling tool.

16. The earth-boring drilling tool of claim 15, further comprising a seal disposed at the connection point.

17. A method of forming an earth-boring drilling tool, the method comprising:

forming a pocket within a front surface of a blade of an earth-boring drill bit;

forming an aperture extending through the blade from the pocket to a back surface of the blade;

securing an instrumented cutting element into the pocket including routing a lead wire coupled to an embedded sensor of the instrumented cutting element through the aperture of the blade, wherein the sensor is configured to obtain data relating to at least one parameter related to at least one of a diagnostic condition of the cutting element, a drilling condition, a wellbore condition, a formation condition, or a condition of the earth-boring drilling tool;

securing a conduit system extending along the back surface of the blade including receiving and routing the lead wire through the conduit system into a bit body to couple with a data acquisition module;

wherein securing the instrumented cutting element into the pocket includes inserting a conduit attached to the instrumented cutting element into the aperture of the blade;

the method further comprising:

inserting a temporary guide tube into the back of the aperture of the blade to receive the lead wire while the instrumented cutting element is being secured; and removing the temporary guide tube from the aperture of the blade after the instrumented cutting element is secured and before securing the conduit system to the blade.

18. The method of claim 17, wherein securing the instrumented cutting element into the pocket includes brazing.

19. The method of claim 17, further comprising:

routing the lead wire and connector through a first section of the conduit system;

connecting the connector with another connector coupled to additional wiring;

routing the additional wiring through a second section of the conduit system; and detachably coupling the first section of the conduit system and the second section of the conduit system.

20. The method of claim 19, further comprising replacing the instrumented cutting element by:

decoupling the first section of the conduit system and the second section of the conduit system;

disconnecting the connector from the another connector;

debrazing the instrumented cutting element from the pocket of the blade;

securing a replacement cutting element into the pocket of the blade;

connecting a connector of the replacement cutting element with the another connector; and coupling the first section of the conduit system and the second section of the conduit system.

* * * * *